United States Patent [19]

Eysn et al.

[11] Patent Number: 4,951,928

[45] Date of Patent: Aug. 28, 1990

[54] BLOWING LANCE ARRANGEMENT

[75] Inventors: Manfred Eysn, Puchenau; Ernest Fuhrmann, Altenberg; Hans Grabner, Linz; Ernst Höllwarth, Sierning; Hellmuth Smejkal, Linz, all of Austria

[73] Assignee: Voest-Alpine Industrienlagenbau Gesellschaft m.b.H., Linz, Austria

[21] Appl. No.: 337,920

[22] Filed: Apr. 14, 1989

[30] Foreign Application Priority Data

Apr. 25, 1988 [AT] Austria ..... 1044/88

[51] Int. Cl.[5] ..... C21C 7/072

[52] U.S. Cl. ..... 266/225; 266/270

[58] Field of Search ..... 266/225, 270

[56] References Cited

U.S. PATENT DOCUMENTS 3,743,814 7/1973 Oakes ..... 266/225

4,301,969 11/1981 Sharp ..... 266/225

FOREIGN PATENT DOCUMENTS 1002366 3/1983 U.S.S.R. ..... 266/270

*Primary Examiner*—S. Kastler

*Attorney, Agent, or Firm*—Hopgood, Calimafde, Kalil, Blaustein & Judlowe

[57] ABSTRACT

A blowing lance to be used for the treatment of metallurgical melts includes a lance head having several expansion tuyeres directed to the bath level of the melt and penetrating a front plate of the lance head. They depart from at least one lance channel, which is peripherally surrounded by a supply channel and a return channel for a cooling medium. The supply channel is separated from the return channel by a flow deflection piece arranged above the front plate and penetrated by at least one connecting channel connecting the supply and return channels and provided for the cooling medium. In order to considerably increase the service life of the blowing lance and to avoid leakages in the front plate, at least one coolant secondary channel is provided in addition to the at least one connecting channel, which, upon branching off a partial stream of the coolant flowing to the connecting channel, diverts this partial stream into a flow direction deviating from the flow direction in the connecting channel and whose mouth is directed directly towards the center of the front plate.

4 Claims, 3 Drawing Sheets

BLOWING LANCE ARRANGEMENT

Figure 1:
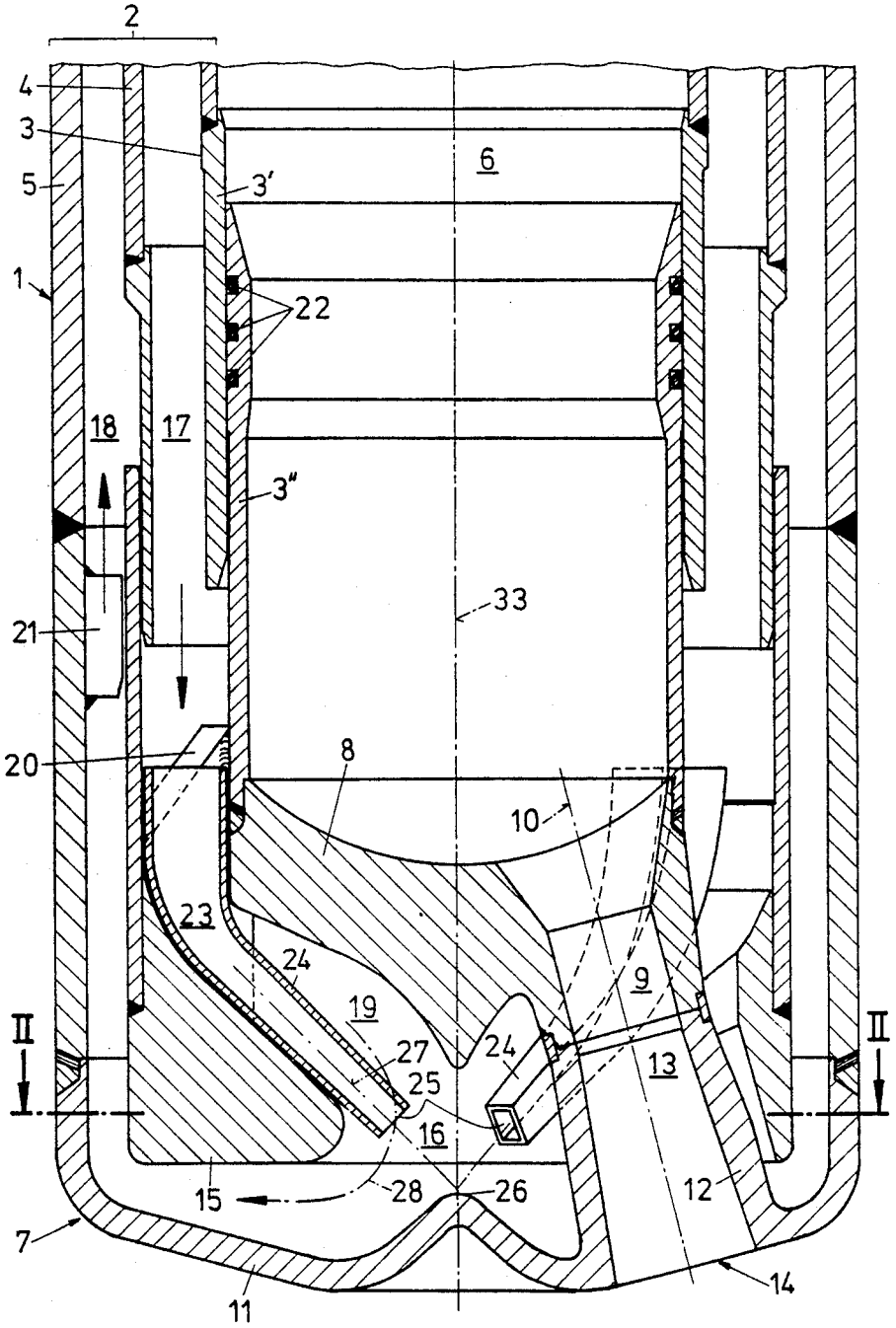

The invention relates to a blowing lance to be used for the treatment of metallurgical melts and comprising a lance head including several expansion tuyeres directed to the bath level of the melt, penetrating a front plate of the lance head and departing from at least one lance channel, which at least one lance channel is peripherally surrounded by a supply channel and a return channel for a cooling medium, the supply channel being separated from the return channel by a flow deflection piece arranged above the front plate and penetrated by at least one connecting channel connecting the supply and return channels and provided for the cooling medium.

With blowing lances of this type (DE-C-27 12 745), which, in practice, have proved successful with various metallurgical processes, such as, e.g., the LD- and LDAC-processes, the front plate is exposed to important thermal loads derived from the steel melt. With an insufficient cooling of the front plate, premature wear may occur due to material slicing, leading to leakages in the front plate.

Therefore, solutions have been sought to improve the cooling of the thermally highly stressed front plate. Thus, for instance, according to DE-C 27 12 745, a flow deflection piece is provided between the supply and return channels to promote cooling, which is designed in a manner that a constant flow cross section is maintained at an increasing contraction between the adjacent expansion tuyeres in the horizontal plane, due to the proportionate enlargement of the flow cross section in the vertical plane. This serves to ensure a uniformly high flow speed of the coolant at the front plate.

However, the center of the front plate continues to be a problem site, at which only a relatively low coolant flow speed prevails even with this known solution. Thus, vapour bubbles may form in the center of the front plate, which again may lead to leakages.

The invention aims at avoiding these disadvantages and difficulties and has as its object to provide a blowing lance with which the sufficient cooling even of the central region of the front plate is ensured such that the front plate no longer will constitute a weak point and the service life of the blowing lance will be considerably increased.

In accordance with the invention, this object is achieved in that, in addition to the at least one connecting channel, at least one coolant secondary channel is provided, which, upon branching off a partial stream of the coolant flowing to the connecting channel, diverts this partial stream into a flow direction deviating from the flow direction within the connecting channel and whose mouth is directed directly towards the center of the front plate.

Particularly favorable flow conditions will adjust if the flow axis of the outlet cross section of the mouth of the coolant secondary channel is disposed at an angle relative to the flow axis of the coolant flow prevailing in the connecting channel at the mouth of the coolant secondary channel.

A particularly preferred embodiment is characterized in that the coolant secondary channel(s) is (are) directed radially asymmetrical to the center of the cross section of the lance head.

The asymmetric supply of a coolant partial stream provokes an intensive swirling of the flow present at the front plate such that regions of substantially reduced coolant flow speeds as adjust with known symmetric flow conditions will be prevented.

An embodiment easy to realize is characterized in that the at least one coolant secondary channel is arranged within the connecting channel.

A particularly intense flow in the central region of the front plate may be achieved in that the at least one coolant secondary channel has a closed cross section as well as an internal cross section that decreases from its beginning to its end.

A structurally simple embodiment is characterized in that the at least one coolant secondary channel has a cross section that is open towards one side.

An embodiment in which any turbulence at the front plate is avoided and a high coolant flow speed, nevertheless, is ensured at the entire front plate, in particular, in its center, is characterized in that at least one bore departing from the supply channel penetrates a bottom portion downwardly delimiting the at least one lance channel, from the side as far as to the center thereof and verges into a bore still penetrating the bottom part vertically, which bores form the coolant secondary channel, a channel extension advantageously being joined to the vertical bore, reaching to near the center of the front plate and closed on all sides.

Figure 2:
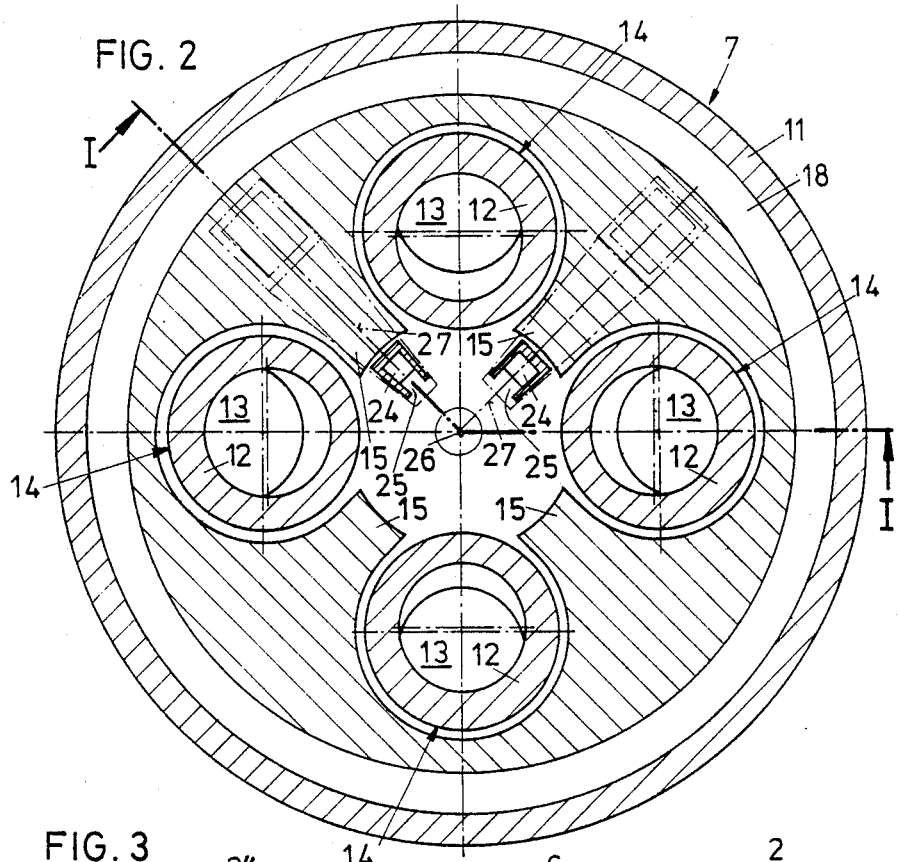
Figure 3:
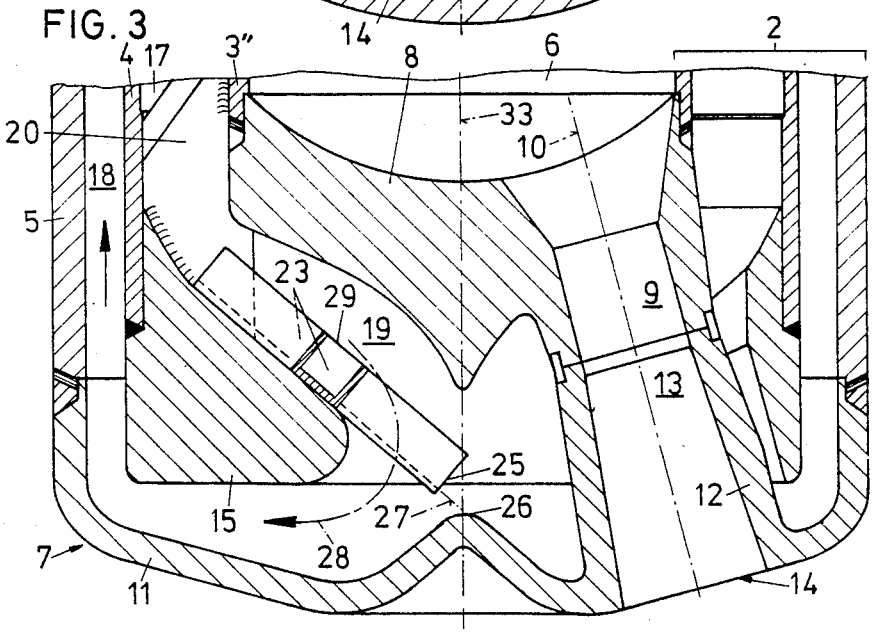
Figure 4:
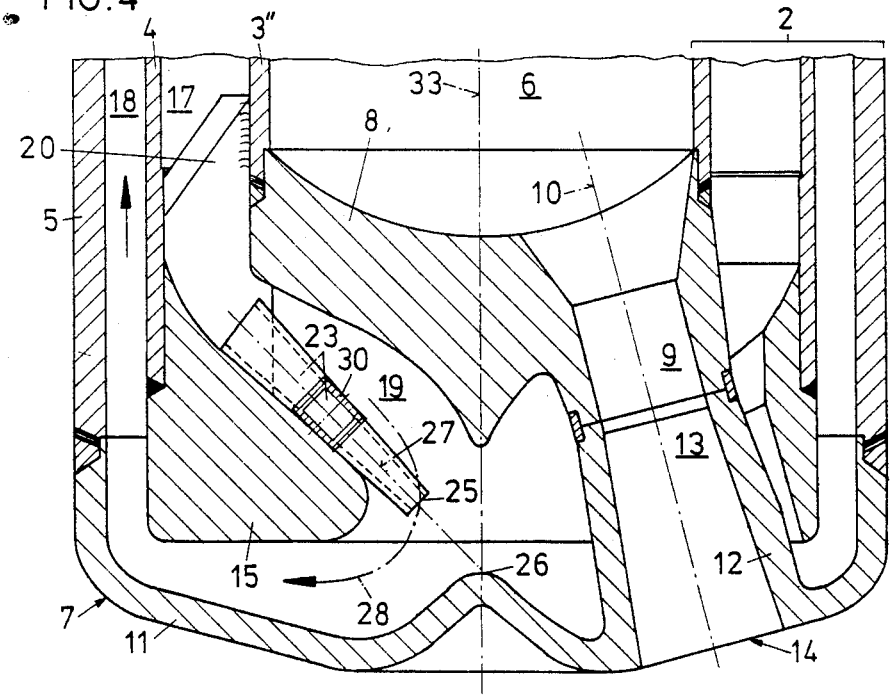
Figure 5:
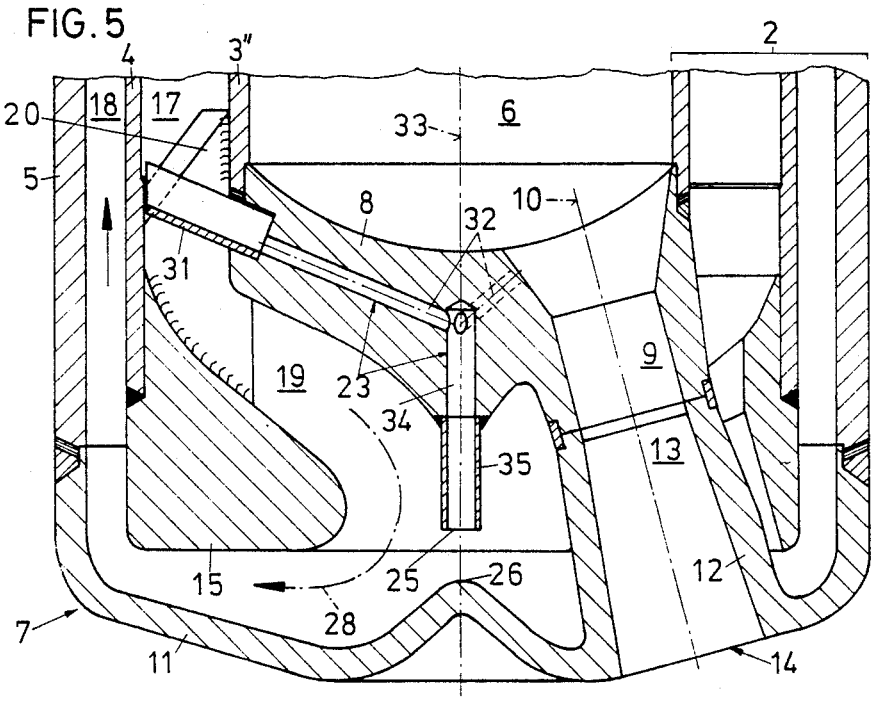

The invention will now be explained in more detail by way of several embodiments with reference to the accompanying drawing, wherein: FIG. 1 is a longitudinal section through a blowing lance according to a first embodiment; FIG. 2 is a section along line II—II of FIG. 1; and FIGS. 3, 4 and 5 represent further embodiments in illustrations analogous to FIG. 1.

A blowing lance 1 for top-blowing oxygen onto the surface of a melt being, e.g., in a converter comprises a water-cooled outer shell 2 composed of three concentrically arranged pipes 3, 4, 5. By the internal pipe 3, a central lance channel 6 is formed, through which oxygen is fed to the lance head 7. The lance channel 6 is closed by a bottom portion 8 on its lower end. Gas passages 9, whose axes 10 are arranged in a diverging manner, lead outwards through this bottom portion 8 and are led through the front plate 11 delimiting the lance head 7 on the side of the melt, as will be explained in the following.

The front plate 11 is welded to the outer shell pipe 5 and includes inwardly directed pipe sockets 12 following upon the gas passages 9 of the bottom portion 8 in an aligned manner. The gas passages 9, together with the internal spaces 13 of the pipe sockets 12 widening outwardly in cross section, constitute the expansion tuyeres 14.

As is apparent from FIG. 2, four of such expansion tuyeres 14 are provided. They are arranged in a radially symmetric manner. To the end side of the middle pipe 4, a flow deflection piece 15 located between the bottom portion 8 and the front plate 11 is welded, which has a central passage 16 and, by the latter and together with the bottom portion 8 and the front plate 11, forms a connecting channel 19, which connects the supply channel 17 and the return channel 18 formed by the pipes 3, 4 and by the pipes 4, 5, respectively. The cooling medium is supplied to the connecting channel 19 through the supply channel 17 and in the latter is deflected towards the front plate 11 upon flowing through the central passage 16. Then it streams radially outwards along the front plate 11 in the direction towards the return channel 18. The pipe sockets 12 of the front plate 11 extend through the flow deflection piece 15 with a lateral play so that also the cooling of these pipe sockets 12 is guaranteed.

Spacers 20, 21 are each inserted between the pipes 3, 4, 5 in order to secure the relative position of these pipes and, thus, the flow cross sections of the supply and return channels 17, 18. To compensate for longitudinal expansions, the central pipe 3 is composed of two pipe sections 3', 3'', the lower pipe section 3'' welded to the bottom part 8 projecting into the upwardly extending pipe section 3', sealings 22 being provided between these pipe sections.

According to the embodiment illustrated in FIG. 1, two radially asymmetrically arranged coolant secondary channels 23 are provided, i.e., are located in just one half of the cross section (cf. FIG. 2), each of the coolant secondary channels being formed by a pipe 24 closed on all sides. Each coolant secondary channel 23 departs from the supply channel 17 and serves to branch off a partial stream of the coolant supplied. Each partial stream is diverted into a flow direction deviating from the flow direction in the connecting channel 19, by means of the coolant secondary channels 23. The mouth or outlet 25 of each coolant secondary channel 23 is directed directly towards the center 26 of the front plate 11, which forms a projection reaching into the interior of the blowing lance.

The flow axis 27 of the exit cross section of the mouth 25 of each coolant secondary channel 23 is disposed at an angle relative to the flow axis 28 of the flow prevailing in the connecting channel 19 at the mouth or outlet 25 of the coolant secondary channel 23. The coolant secondary channels 23 cause the coolant flow within the connecting channel 19, which were radially symmetric without coolant secondary channels 23, to swirl, thus creating a radially asymmetric flow, which ensures a coolant flow of a sufficiently high speed in the center of the front plate, thereby cooling the particularly jeopardized center 26 of the front plate 11 to a sufficient extent.

According to the embodiment illustrated in FIG. 3, one coolant secondary channel 23 is formed by a linearly extending gutter 29 having a U-shaped cross section and whose mouth is likewisely directed towards the center 26 of the front plate 11.

The embodiment illustrated in FIG. 4 comprises a coolant secondary channel 23 which is formed by a pipe section 30 closed on all sides, similarly to the coolant secondary channel 23 represented in FIG. 1. This pipe section, like the variant illustrated in FIG. 1, has an internal cross section that decreases from its beginning to its end, i.e., in the flow direction, whereby a partial stream particularly effective with regard to its flow speed is directed to the center 26 of the front plate 11.

According to the variant illustrated in FIG. 5, collecting plates 31 are installed at the origin of the connecting channel 19, each being adjoined by a bore 32 leading to the center of the bottom portion 8. There may be provided one or more uniformly distributed collecting plates 31. A further bore 34 provided exactly in the axis 33 of the blowing lance follows upon the bores 32 leading into the center, through which bore 34 the partial streams of the coolant diverted over the collecting plates are conducted towards the center 26 of the front plate 11. Suitably, a pipe section 35 arranged in the direction of the axis 33 follows upon this bore 34, through which the branched off coolant flow emerging from the former may be guided to near the center 26 of the front plate 11 without being affected by the flow in the connecting channel 19.

What we claim is:

1. In a blowing lance arrangement for use in treating a metallurgical melt having a bath surface, wherein said blowing lance includes a lance head having a front plate, at least one lance channel, a plurality of expansion tuyeres communicating with said at least one lance channel and extending through said head and said front plate for direct access to the bath surface of said melt, wherein said lance includes coolant supply means and coolant return means peripherally surrounding said at least one lance channel with a flow deflection piece disposed above said front plate to thereby separate said coolant supply and said coolant return means, and wherein said lance further includes at least one coolant connecting channel arranged to penetrate said flow deflection piece so as to connect said coolant supply and said coolant return means, and at least one coolant secondary channel having an outlet disposed directly towards the center of said front plate capable of diverting a partial stream of said coolant to said connecting channel and thereby supply said partial stream to said connecting channel, the improvement, wherein said outlet of said at least one coolant secondary channel has a cross-section such that its flow axis is disposed at an angle to the flow axis of the coolant flow prevailing in said one coolant connection channel at said outlet, said outlet being disposed radially asymmetrical to the center of said front plate and thereby cause an intensive swirling of the partial stream with the mainstream above the front plate to assure efficient cooling of said front plate.

2. A blowing lance arrangement as set forth in claim 1, wherein said at least one coolant secondary channel is arranged within said at least one coolant connecting channel.

3. A blowing lance arrangement as set forth in claim 1, wherein said at least one coolant secondary channel has a closed cross section and an internal cross section decreasing from its beginning to its end.

4. A blowing lance arrangement as set forth in claim 1, wherein said at least one coolant secondary channel has a cross section open to one side.

* * * * *